US005743198A

United States Patent [19]

Yamanaka et al.

[11] Patent Number: 5,743,198

[45] Date of Patent: Apr. 28, 1998

[54] SEWING MACHINE HAVING CYLINDER BED

[75] Inventors: Masami Yamanaka; Yoji Seto, both of Osaka, Japan

[73] Assignee: Pegasus Sewing Machine Mfg. Co., Ltd., Osaka, Japan

[21] Appl. No.: 856,207

[22] Filed: May 14, 1997

[30] Foreign Application Priority Data

May 15, 1996 [JP] Japan ..... 8-146592

[51] Int. Cl.[6] ..... D05B 27/08

[52] U.S. Cl. ..... 112/63; 112/313

[58] Field of Search ..... 112/63, 309, 312, 112/313, 314, 323, 163, 167

[56] References Cited

U.S. PATENT DOCUMENTS 4,674,426 6/1987 Kasuda et al. .
4,883,005 11/1989 Wehmeyer ..... 112/63
5,458,073 10/1995 Harada ..... 112/63

FOREIGN PATENT DOCUMENTS 57-164090 10/1982 Japan .
7-28966 4/1995 Japan .

*Primary Examiner*—Peter Nerbun
*Attorney, Agent, or Firm*—Flynn, Thiel, Boutell & Tanis, P.C.

[57] ABSTRACT

A sewing machine having a cylinder bed feeds cloth in the direction orthogonal to the longitudinal direction of the cylinder bed, with a main feed dog and differential feed dog provided in the cylinder bed projecting from a bed main body of the sewing machine. The main feed bar, differential feed bar, main feed oscillating shaft and differential feed oscillating shaft for moving each feed bar back and forth, and front and rear vertical oscillating shafts for moving both feed bars up and down are provided in the cylinder bed, while all other mechanisms for the main feed dog and differential feed dog are provided inside the bed main body, so that the cylinder bed may be designed thinly.

1 Claim, 7 Drawing Sheets

SEWING MACHINE HAVING CYLINDER BED

FIELD OF THE INVENTION

The present invention relates to a sewing machine having a cylinder bed suited to sewing of a ring form or tube form of small diameter, such as neck of a T-shirt, and covering and hemming of sleeves of children's clothes and training shirts, and having a differential feed mechanism.

BACKGROUND OF THE INVENTION

When sewing such a ring form or tube form of small diameter, hitherto, a sewing machine having a cylinder bed is used by forming the sewing portion of the bed into a slender tube. In such a sewing machine, the thickness of the cylinder bed is determined by the size of the cloth feed mechanism incorporated in the cylinder bed, and if the cylinder bed is designed to be thin, it is hard to assemble a differential feed mechanism which is required in sewing a rib in the sleeve.

Japanese Publication No. Hei 7-28966 of examined application discloses a sewing machine incorporating a differential feed mechanism and feed amount adjusting mechanism in the cylinder bed, but in the cylinder bed incorporating the differential feed amount adjusting mechanism, there is a limit in reducing its thickness.

As disclosed in Japanese Publication No. Sho 57-164090 of patent application, a sewing machine having the cloth feed direction defined in the longitudinal direction of a cylinder bed is also known. When sewing the sleeve by such a sewing machine, the sleeve is obliquely applied on the end portion of the cylinder bed in sewing, but such sewing requires an advanced skill, and the working efficiency was poor.

SUMMARY OF THE INVENTION

It is hence an object of the invention to provide a sewing machine having a cylinder bed reduced in its thickness, capable of sewing a ring form or tube form of small diameter easily, and realizing differential feed.

To achieve the object, the cylinder bed projects orthogonally to the cloth feed direction from the main body of the bed of the sewing machine. Inside the cylinder bed are disposed, in parallel, a main feed bar mounting a main feed dog and a differential feed bar mounting a differential feed dog, and moreover an oscillating shaft for main feed for moving the main feed bar back and forth in the cloth feed direction, formed as a part of a horizontal moving mechanism for moving the main feed dog in the cloth feed direction orthogonal to the longitudinal direction of the bed, an oscillating shaft for differential feed for moving the differential feed bar back and forth, formed as a part of a horizontal moving mechanism for moving the differential feed dog in the cloth feed direction orthogonal to the longitudinal direction of the bed, and an oscillating shaft for front vertical motion and an oscillating shaft for rear vertical motion for moving both feed bars up and down in the front and rear portions, formed as parts of vertical moving mechanisms of the main feed dog and differential feed dog are disposed parallel. On the other hand, in the bed main body are provided a main shaft, a mechanism for main feed for oscillating the oscillating shaft for main feed in cooperation with the main shaft and including an oscillating amount adjusting mechanism, formed as a part of the horizontal moving mechanism of the main feed dog, a mechanism for differential feed for oscillating the oscillating shaft for differential feed in cooperation with the main shaft and including an oscillating amount adjusting mechanism, formed as a part of the horizontal moving mechanism of the differential feed dog, and a front vertical moving mechanism for oscillating the oscillating shaft for front vertical motion in cooperation with the main shaft and a rear vertical moving mechanism for oscillating the oscillating shaft for rear vertical motion in cooperation with the main shaft, formed as a part of the vertical moving mechanisms of both feed dogs.

According to the sewing machine having a cylinder bed of the invention, formed as a part of the longitudinal moving mechanism and vertical moving mechanism including the feed amount adjusting mechanisms for main feed dog and differential feed dog, the mechanisms excluding the main feed bar, differential feed bar, oscillating shaft for moving each feed bar back and forth and oscillating shaft for moving up and down are provided in the bed main body, and therefore the cylinder bed may be designed in a thin size, and a ring form or tube form of small diameter can be sewn easily.

Other features and advantages of the invention will be apparent from the following description taken in connection with the accompanying drawings.

DESCRIPTION OF THE PREFERRED EMBODIMENT

Figure 1:
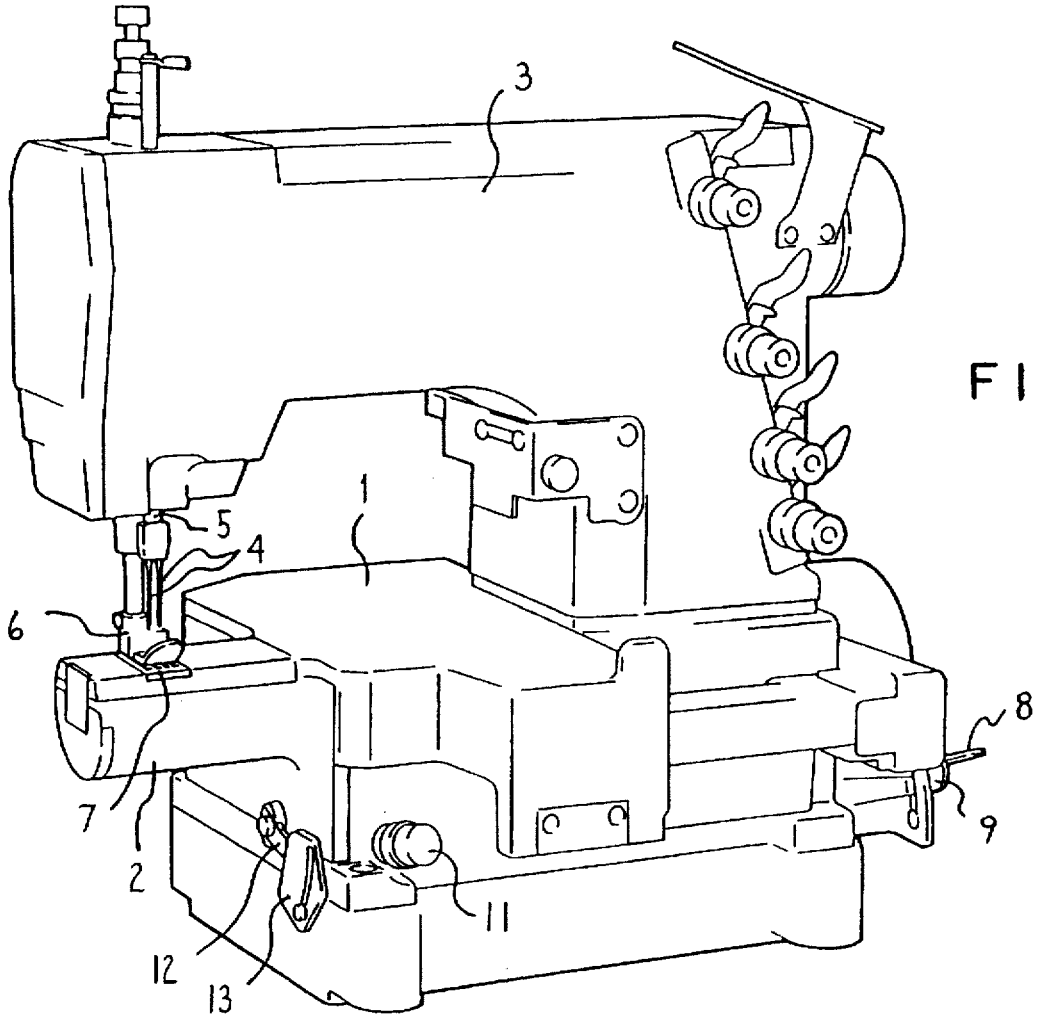
FIG. 1 is a perspective view of an entire sewing machine having a cylinder bed according to the invention.

FIG. 1 shows a sewing machine having cylinder bed according to the invention. The cylinder bed 2 projects from the left side of a bed main body 1. A needle bar 5 having two needles 4 and a presser foot 6 are supported movably in a vertical direction in an arm 3 located above the cylinder bed 2. In the process of feeding the cloth in the direction orthogonal to the longitudinal direction of the cylinder bed 2, the cloth supplied on a needle plate 7 is gripped between the presser foot 6 and the feed dog composed of main feed dog 14 (see FIG. 2) and differential feed dog 41 (see FIG. 4) provided in the cylinder bed 2, the two needles 4 and the looper (not shown) provided in the cylinder bed cooperate to form a stitch such as interlock stitch with cover thread in the cloth.

A lever 8 and a dial plate 9 for adjusting the differential ratio of cloth feed amount are provided at the right side of the bed main body 1. A main feed amount adjusting screw 11 is provided at the front side of the main body 1, and an adjusting lever 12 moving up and down by rotation of the screw 11 and a dial plate 13 are provided at the left side of the bed main body 1.

Figure 2:
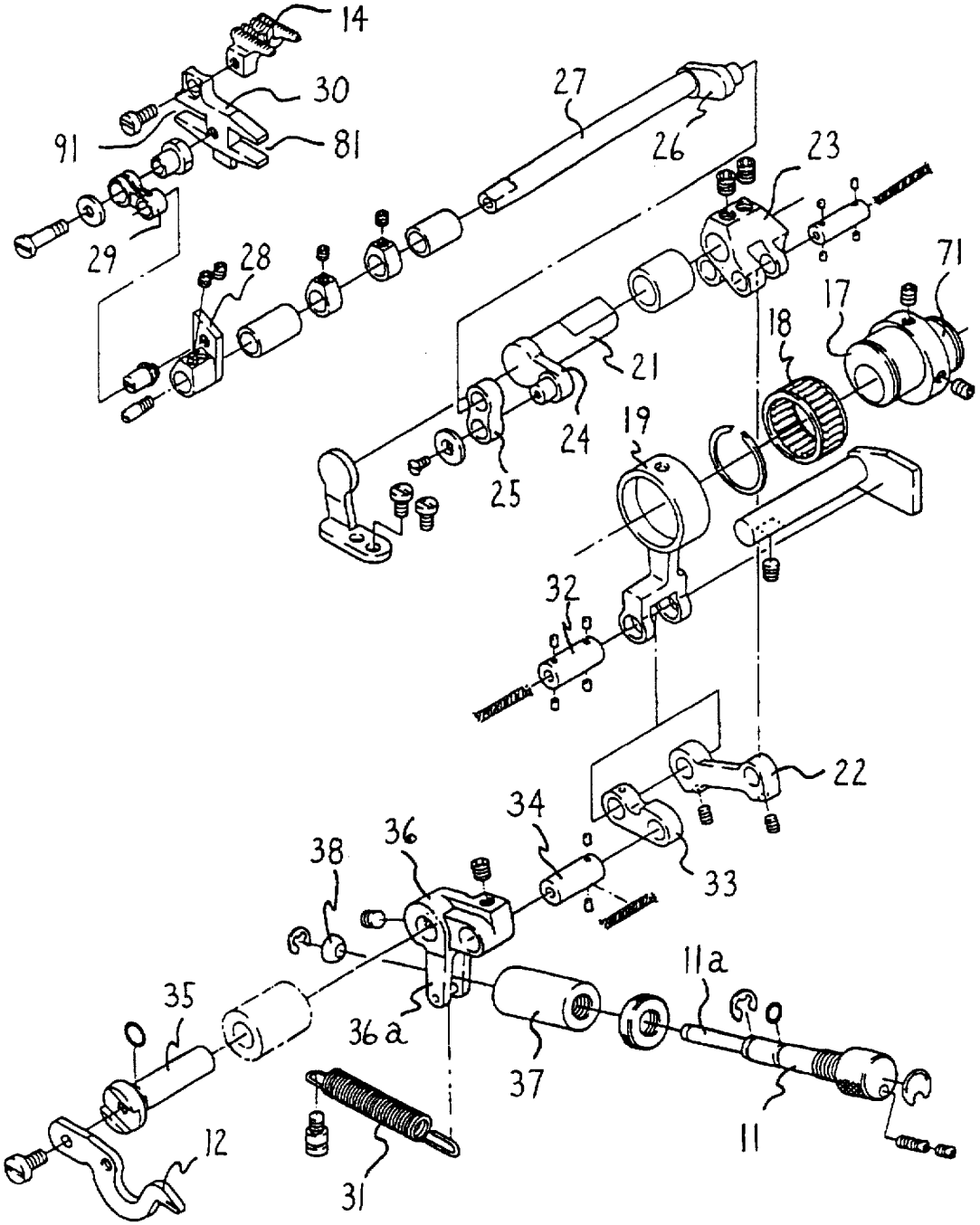
FIG. 2 is an exploded perspective view of a horizontal moving mechanism for moving the main feed dog back and forth.

FIG. 2 shows a horizontal moving mechanism for the main feed dog 14. A main shaft 16 (see FIG. 6) is furnished with an eccentric shaft 17. The eccentric shaft 17 is provided with a feed rod 19 through a roller bearing 18. A crank shaft 21 is furnished with a bell crank type lever 23. This bell crank type lever 23 is coupled to the main shaft 16 through a bifurcate portion of the feed rod 19 and a link 22. A main feed oscillating shaft 27 having a lever 26 is coupled to the bell crank type lever 23 through a link 25 and a crank 24 fixed to the end of the crank shaft 21. A main feed bar 30 mounts the main feed dog 14. This main feed bar 30 in the middle is coupled to the main feed oscillating shaft 27 through a link 29 and a feed arm 28 affixed to the main feed oscillating shaft 27. A link 33 is coupled to the bifurcate portion of the feed rod 19 by a pin 32, together with the link 22. An L-shaped lever 36 is coupled to the feed rod 19 through the link 33 and a pin 34. This L-shaped lever 36 is affixed onto a shaft 35 which is fixed at the adjusting lever 12 through the left side of the bed main body 1. A pin 11*a* at the leading end of the adjusting screw 11 is passed in a bifurcate portion 36*a* of the L-shaped lever 36. one end of a coil spring 31 is linked to the bifurcate portion 36*a* and another end of the coil spring 31 is fixed in the bed main body 1. The bifurcate portion 36*a* is in contact with a stopper 38 affixed to the pin 11*a* of the adjusting screw 11 by the coil spring 31, so that the L-shaped lever 36 may rotate together with the shaft 35 by rotation of the adjusting screw 11.

The operation of the horizontal moving mechanism of this main feed dog 14 is described below. By the rotation of the main shaft 16, the link 33 oscillates about the pin 34 through the feed rod 19. By this oscillation of the link 33, the link 22 coupled to the feed rod 19 is oscillated together with the link 33. By the oscillation of this link 22, the main feed oscillating shaft 27 oscillates through the bell crank type lever 23 and crank shaft 21. Consequently, the main feed bar 30 moves back and forth. The fulcrum position of the link 33 can be changed by turning the L-shaped lever 36 through rotation of the adjusting screw 11 so that the horizontal moving amount is changed. At this time, the feed amount is displayed at the position of the adjusting lever 12 on the dial plate 13.

Figure 3:
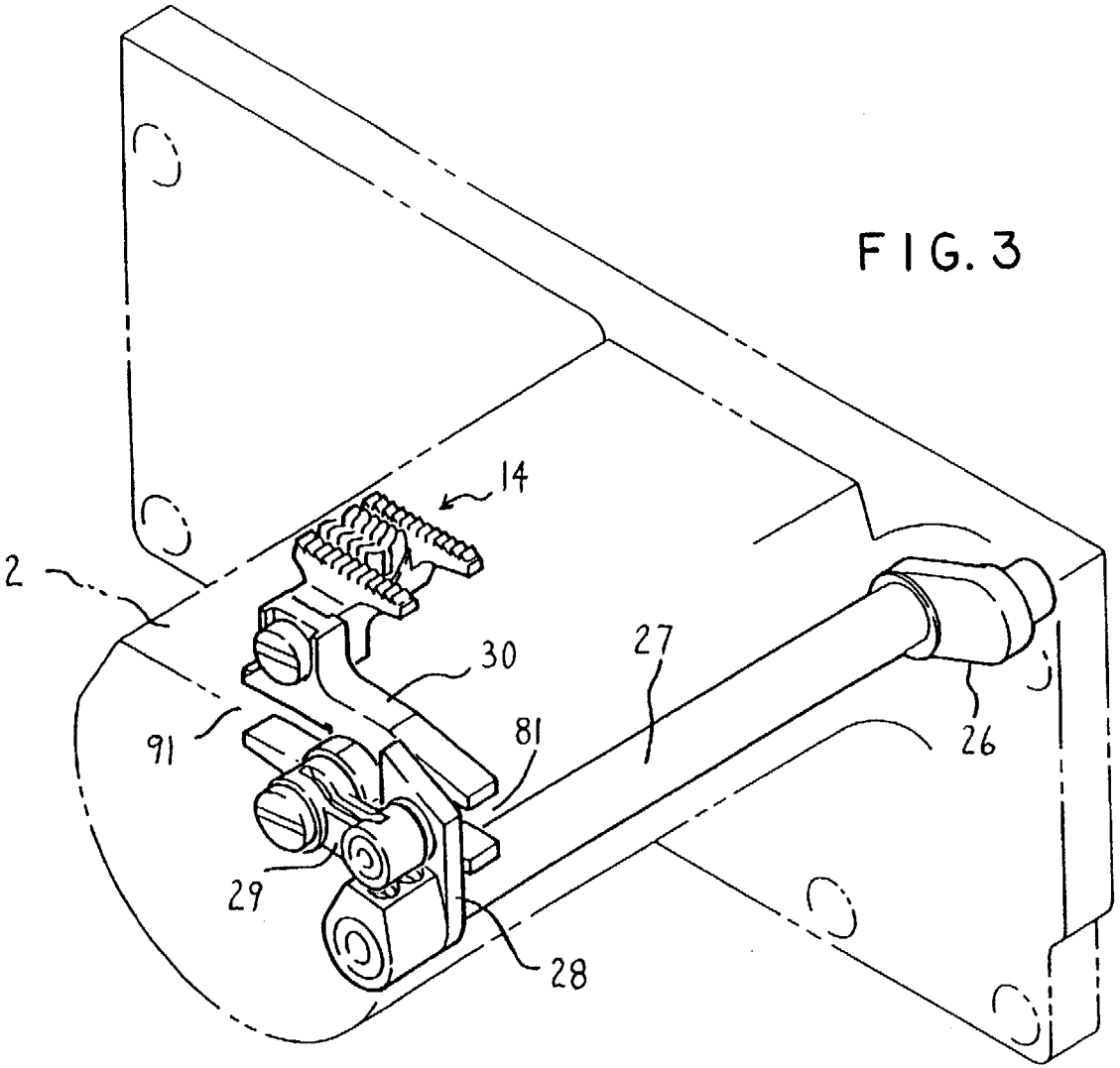
FIG. 3 is a perspective view of a horizontal moving mechanism for a main feed dog provided in the cylinder bed.

As the horizontal moving mechanism of the main feed dog 14, as shown in FIG. 3, the main feed bar 30 and the main feed oscillating shaft 27 coupled to the main feed bar 30 through the link 29 are provided in the cylinder bed 2. However, other mechanisms including the feed amount adjusting mechanism are all provided inside the bed main body 1.

Figure 4:
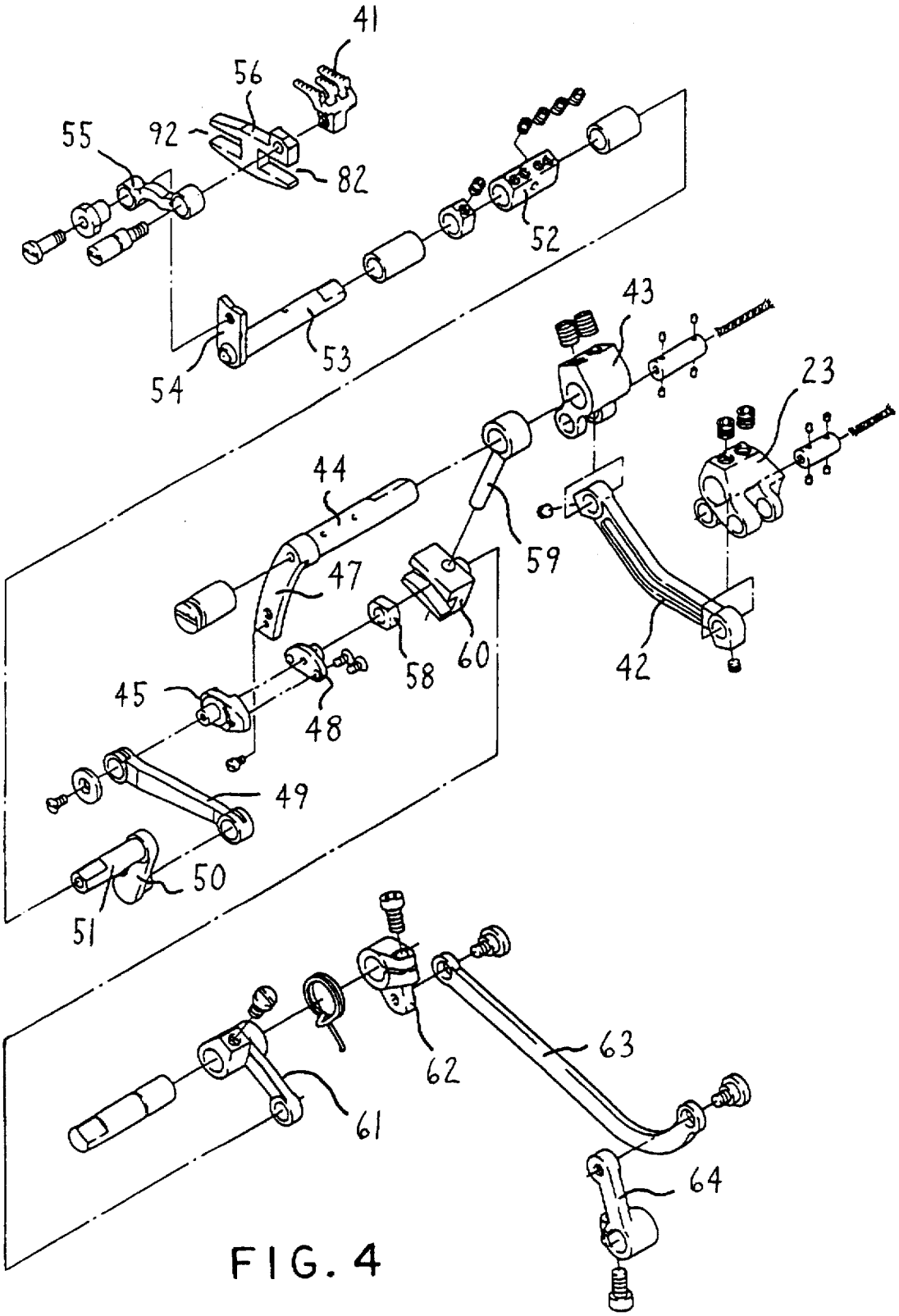
FIG. 4 is an exploded perspective view of a horizontal moving mechanism for moving a differential feed dog back and forth.

FIG. 4 shows a horizontal moving mechanism for the differential feed dog 41. A crank shaft 44 affixing a crank 43 is coupled to the feed rod 19 (see FIG. 2) through the bell crank type lever 23 and a link 42. An arm 47 is fixed to a end of this crank shaft 44. A pair of sliders 45, 48 are slidably attached to this arm 47. A crank shaft 51 having a crank 50 is coupled to the arm 47 through one slider 45 and a link 49. A differential feed oscillating shaft 53 is connected to the crank shaft 51 through a collar 52. One end of a differential feed arm 54 is affixed to a end of the differential feed oscillating shaft 53. A differential feed bar 56 is coupled to the differential feed arm 54 of the differential feed oscillating shaft 53 through a link 55. A differential feed dog 41 is attached to the differential feed bar 56. An oscillating motion of the bell crank type lever 23 caused by rotation of the main shaft 16 is transmitted to the differential feed oscillating shaft 53 through the arm 47, one slider 45, and link 49. As a result, the differential feed bar 56 is moved back and forth.

Described below is a structure for adjusting the feed amount of the differential feed dog 41 attached to the differential feed bar 56. A guide bar 59 is rotatably fitted to the crank shaft 44. A guide member 60 is slidably supported in the guide bar 59. A square piece 58 supported by other slider 48 is fitted in this guide member 60. The guide member 60 is coupled to a lever 61. By rotation of this lever 61, the slider 48 slide along the arm 47 through the guide member 60. This guide member 60 is coupled to an arm 64 through a link 63 and a crank 62 coupled integrally to the lever 61. This arm 64 rotates in cooperation with the vertical move operation of the lever 8. By the vertical move operation of the lever 8, the pair of sliders 45, 48 move along the arm 47 through the lever 61, crank 62, link 63 and arm 64. As a result, the oscillation amount to be transmitted to the differential feed oscillating shaft 53 can be changed by varying a radial position of the slider 45 from the crank shaft 44.

Figure 5:
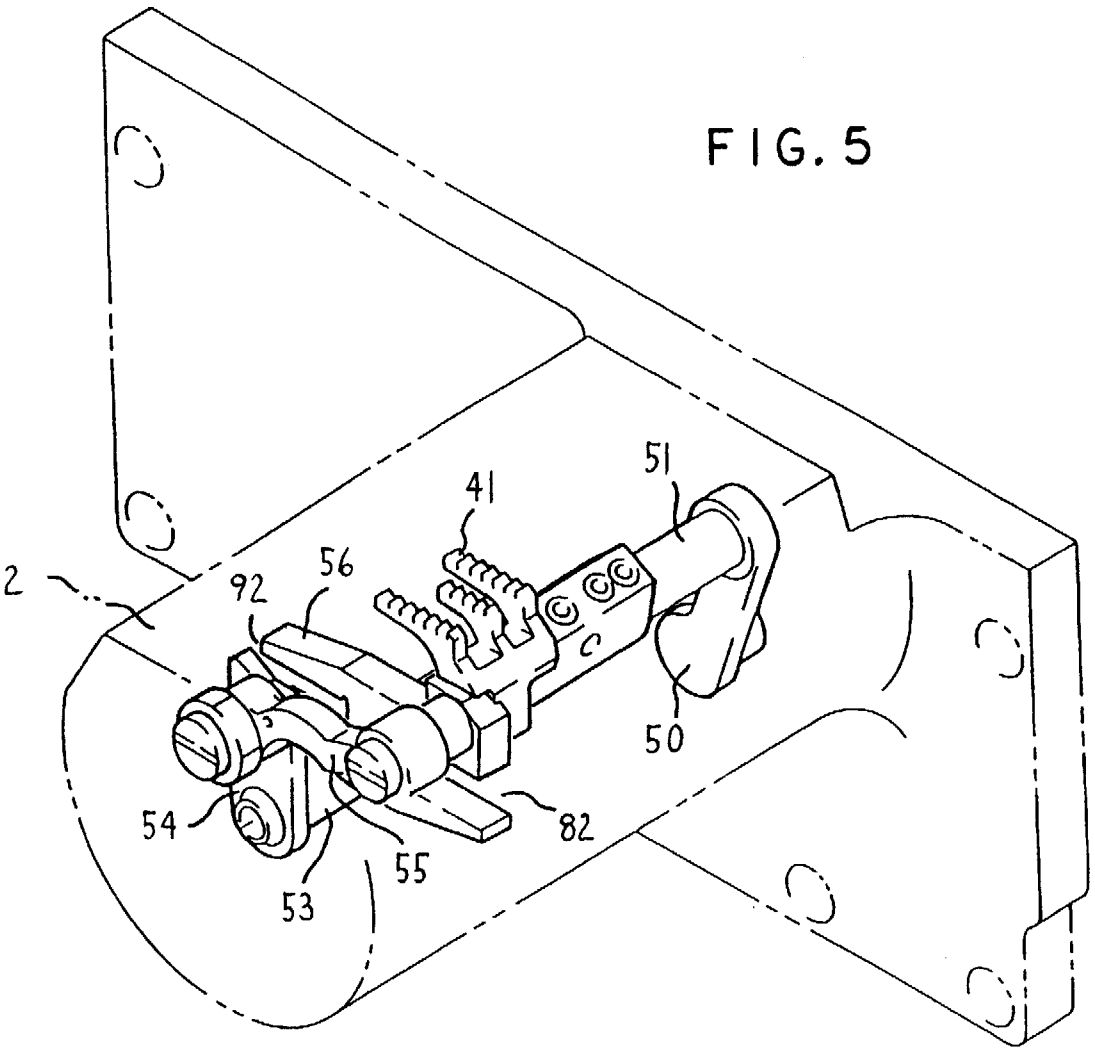
FIG. 5 is a perspective view of a horizontal moving mechanism for a differential feed dog provided in the cylinder bed.

As the horizontal moving mechanism of the differential feed dog 41, same as in the case of the horizontal moving mechanism of the main feed dog, as shown in FIG. 5, the differential feed bar 56 and the differential feed oscillating shaft 53 coupled to the differential feed bar 56 through the link 55 are provided in the cylinder bed. However, all other mechanisms including the feed amount adjusting mechanism are provided in the bed main body 1.

Figure 6:
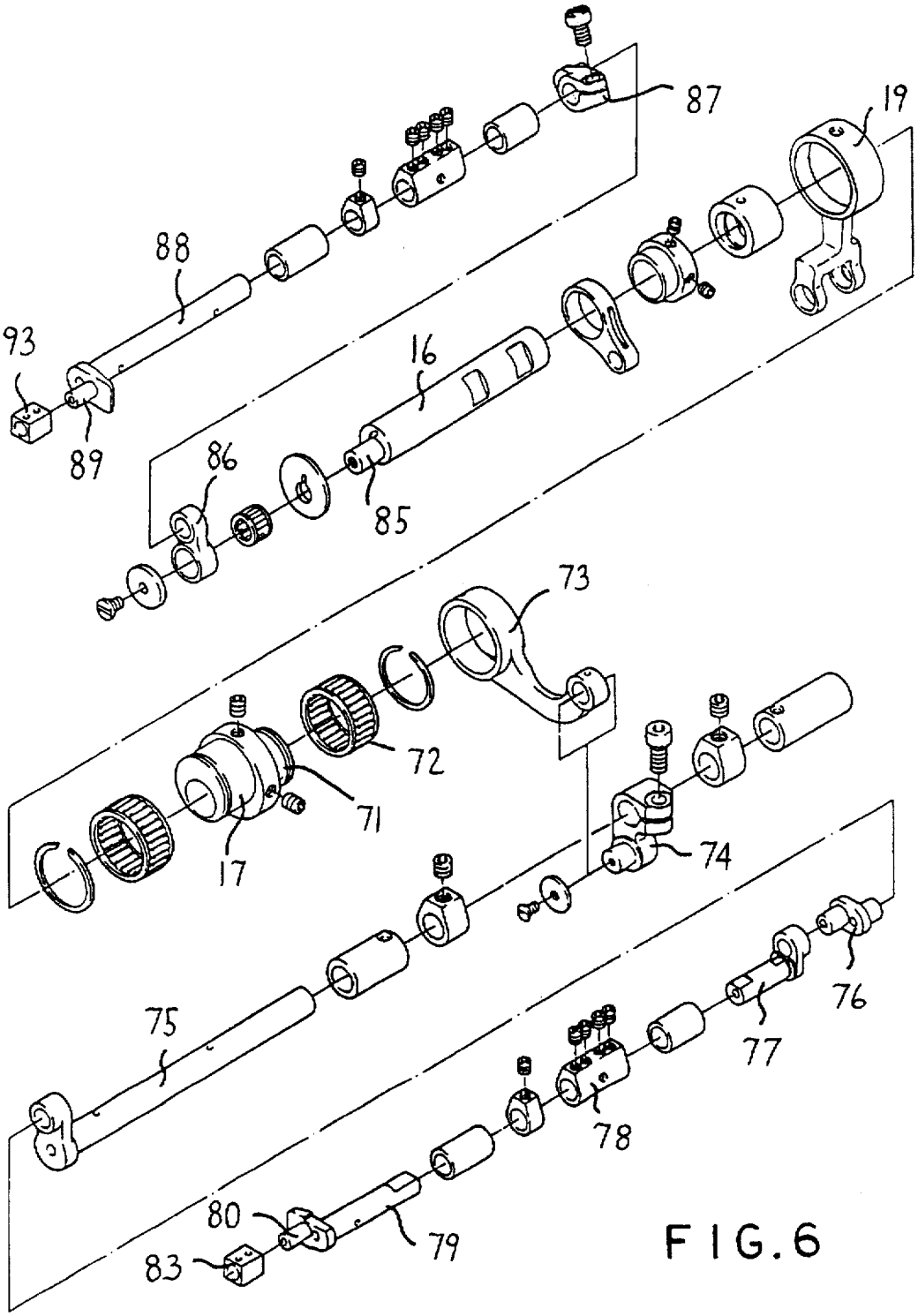
FIG. 6 is an exploded perspective view a vertical moving mechanism for moving the feed bar up and down.

FIG. 6 shows a vertical moving mechanism for the main feed dog 14 and differential feed dog 41. The vertical moving mechanism of both feed dogs is composed of a front vertical moving mechanism and a rear vertical moving mechanism.

First, the front vertical moving mechanism is described. In the main shaft 16, an eccentric shaft 71 is fixed, together with the eccentric shaft 17. The eccentric shaft 71 is furnished with a vertical rod 73 through a roller bearing 72. The vertical rod 73 is coupled to a crank 74 affixed to a crank shaft 75 so as to oscillate in cooperation with the main shaft 16. The crank shaft 75 is coupled to a crank shaft 77 through a crank 76. The crank shaft 77 is connected to a front vertical oscillating shaft 79 through a collar 78. A square piece 83 is supported on an eccentric pin 80 projecting from the front vertical oscillating shaft 79. This square piece 83 is slidably fitted to front guide grooves 81, 82 of the main feed bar 30 and differential feed bar 56. This front vertical oscillating mechanism is designed to move up and down the front portion of the both feed bars 30, 56 as the square piece 83 turns relatively about the eccentric pin 80 by the oscillation of the front vertical oscillating shaft 79.

Next, the rear vertical moving mechanism is described. At a end of the main shaft 16, an eccentric pin 85 is projects. The eccentric pin 85 is coupled to a link 86. The link 86 is coupled to a crank 87 affixed to a rear vertical oscillating shaft 88. A square piece 93 is supported on an eccentric pin 89 projecting from the front vertical oscillating shaft 88. This square piece 93 is slidably fitted to rear guide grooves 91, 92 of the main feed bar 30 and differential feed bar 56. This rear vertical oscillating mechanism is designed to move up and down the rear portion of the both feed bars 30, 56 through the square piece 93 by the oscillating motion of the rear vertical oscillating shaft 88 oscillating in cooperation with the main shaft 16.

Figure 7:
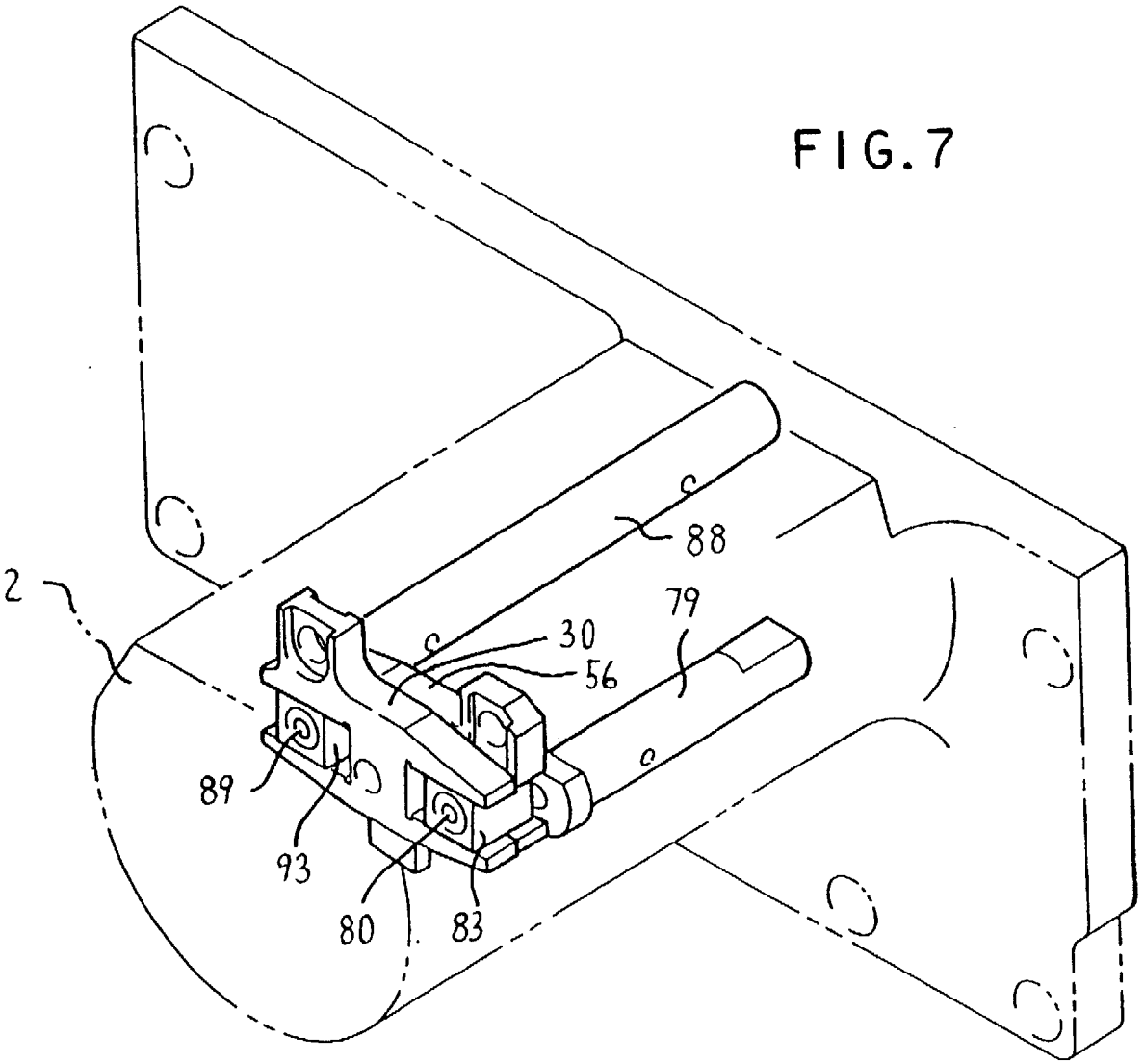
FIG. 7 is a perspective view of a vertical moving mechanism for a feed bar provided in the cylinder bed.

As the vertical moving mechanism of both feed bars 30, 56, as shown in FIG. 7, aside from the both feed bars 30, 56, the front vertical oscillating shaft 79, rear vertical oscillating shaft 88, and square pieces 83, 93 are provided in the cylinder bed 2, but all other mechanisms are provided in the bed main body 1.

Thus, out of the horizontal moving mechanism and vertical moving mechanism including the feed amount adjusting mechanism of the main feed dog 14 and differential feed dog 41, both feed bars 30, 56, main feed oscillating shaft 27 and link 29, differential feed oscillating shaft 53 and link 55, front vertical oscillating shaft 79 and square piece 83, and rear vertical oscillating shaft 88 and square piece 93 only are provided in the cylinder bed 2, while all other mechanisms are provided in the bed main body 1.

It is to be understood by those skilled in the art that the foregoing description is a preferred embodiment of the disclosed sewing machine and that various changes and modifications may be made in the invention without departing from the spirit and scope thereof.

What is claimed is:

1. A sewing machine having a cylinder bed for feeding cloth in the direction orthogonal to the longitudinal direction of the cylinder bed projecting from a bed main body of the sewing machine, wherein in the cylinder bed, said sewing machine comprising:

a main feed bar mounting a main feed dog, a differential feed bar mounting a differential feed dog, an oscillating shaft for main feed for moving the main feed bar back and forth in the cloth feed direction formed as a part of a horizontal moving mechanism for moving the main feed dog, an oscillating shaft for differential feed for moving the differential feed bar back and forth formed as a part of a horizontal moving mechanism for moving the differential feed dog, and an oscillating shaft for front vertical motion and an oscillating shaft for rear vertical motion for moving both feed bars up and down in the front and rear portions formed as parts of vertical moving mechanisms of the main feed dog and differential feed dog, and wherein in the bed main body, said sewing machine further comprising:

a main shaft, a main feed mechanism for oscillating the oscillating shaft for main feed in cooperation with the main shaft and including an oscillating amount adjusting mechanism formed as a part of the horizontal moving mechanism for the main feed dog, a differential feed mechanism for oscillating the oscillating shaft for differential feed in cooperation with the main shaft and including an oscillating amount adjusting mechanism formed as a part of the horizontal moving mechanism for the differential feed dog, and a front vertical moving mechanism for oscillating the oscillating shaft for front vertical motion in cooperation with the main shaft and a rear vertical moving mechanism for oscillating the oscillating shaft for rear vertical motion in cooperation with the main shaft out of the vertical moving mechanisms for both feed dogs.

* * * * *

UNITED STATES PATENT AND TRADEMARK OFFICE

CERTIFICATE OF CORRECTION

PATENT NO. : 5 743 198

DATED : April 28, 1998

INVENTOR(S) : Masami Yamanaka et al

It is certified that error appears in the above-indentified patent and that said Letters Patent is hereby corrected as shown below:

Column 6, line 29; change "out" to ---formed as a part---.

Signed and Sealed this

Tenth Day of November 1998

*Attest:*

*Attesting Officer*

BRUCE LEHMAN

*Commissioner of Patents and Trademarks*